US007654690B2

(12) United States Patent
Chuan

(10) Patent No.: US 7,654,690 B2
(45) Date of Patent: Feb. 2, 2010

(54) LAMPSHADE FOR A LIGHT-EMITTING DIODE (LED) LAMP

(76) Inventor: Tang Shih Chuan, No. 58-11, Heping Rd., Tucheng, Taipei (TW)

( * ) Notice: Subject to any disclaimer, the term of this patent is extended or adjusted under 35 U.S.C. 154(b) by 4 days.

(21) Appl. No.: 12/013,462

(22) Filed: Jan. 13, 2008

(65) Prior Publication Data

US 2009/0180287 A1 Jul. 16, 2009

(51) Int. Cl.
*F21S 4/00* (2006.01)
*F21V 21/00* (2006.01)

(52) U.S. Cl. ..... 362/249.02; 362/240; 362/241; 362/245; 362/247; 362/299; 362/300; 362/308; 362/327; 362/433

(58) Field of Classification Search ..... 362/237–238, 362/240–241, 244–245, 247–249, 299–300, 362/307–308, 311, 326–327, 351, 433, 457, 362/545, 249.02
See application file for complete search history.

(56) References Cited

U.S. PATENT DOCUMENTS

2003/0156410 A1* 8/2003 Ter-Hovhannisian ..... 362/241

* cited by examiner

*Primary Examiner*—Jason Moon Han
(74) *Attorney, Agent, or Firm*—Egbert Law Offices PLLC

(57) ABSTRACT

An improved lampshade of an LED lamp, assembled onto the port of hold tank on the main body of LED lamp so that light-reflection modules located between port of hold tank and LED modules in the hold tank are positioned securely. The lampshade has a circumferential locating surface and a limitation surface. The circumferential locating surface is adapted with the wall edge of hold tank to define an inner edge and an external edge. The limitation surface is recessed into the circumferential locating. A snapping portion is placed at the coupling portion of the circumferential locating surface and wall edge of the hold tank for positioning of the lampshade.

4 Claims, 5 Drawing Sheets

LAMPSHADE FOR A LIGHT-EMITTING DIODE (LED) LAMP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a light-emitting diode (LED) lamp, and more particularly to an innovative lamp with an improved lampshade.

2. Description of Related Art Including Information Disclosed Under 37 CFR 1.97 and 37 CFR 1.98.

An LED lamp generally comprises a main body, LED module, heat-radiating component and lampshade.

The lampshade of the LED lamp is generally developed from a traditional light shield. However, LEDs in the LED lamp are distributed in a spotted state, so every LED is fitted with a light-reflection module to magnify the light spots, softening the bright light and generating a decorative spotted effect. Considering the assembly and disassembly work, every light-reflection module must be positioned securely.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Through the structures of the lampshade, the circumferential locating, the limitation surface, the through-hole and the snapping portion are combined. The circumferential locating surface is adapted to the wall edge of the hold tank, providing the lampshade with a reliable, circular support surface. The limitation surface of the lampshade is recessed into an inner edge of the circumferential locating surface, permitting the light-emitting surface of the light-reflection module to recess slightly and making the light-emitting surface aesthetically pleasing. The through-hole on the limitation surface of the lampshade enables rapid sleeving and fixing of the light-reflection modules. With the circumferential locating surface and snapping portion on the wall edge of the hold tank, the lampshade and main body can be positioned and removed rapidly and easily. Thus, the lampshade is formed such that the light-reflection module could be positioned securely and removed easily.

Based upon the structures of the present invention, the circumferential locating surface of the lampshade has a stepped external wall with big and small necks, and the wall edge of the hold tank has a stepped inner wall with big and small treads. The coupling area of the circumferential locating edge of the lampshade and the wall edge of hold tank could be further expanded for better assembly and positioning effects.

Based upon the structures of the present invention, a shoulder is formed at one end of the light-reflection module. The shoulder is located in the through-hole of the limitation surface of the lampshade to further securely fix the light-reflection modules.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
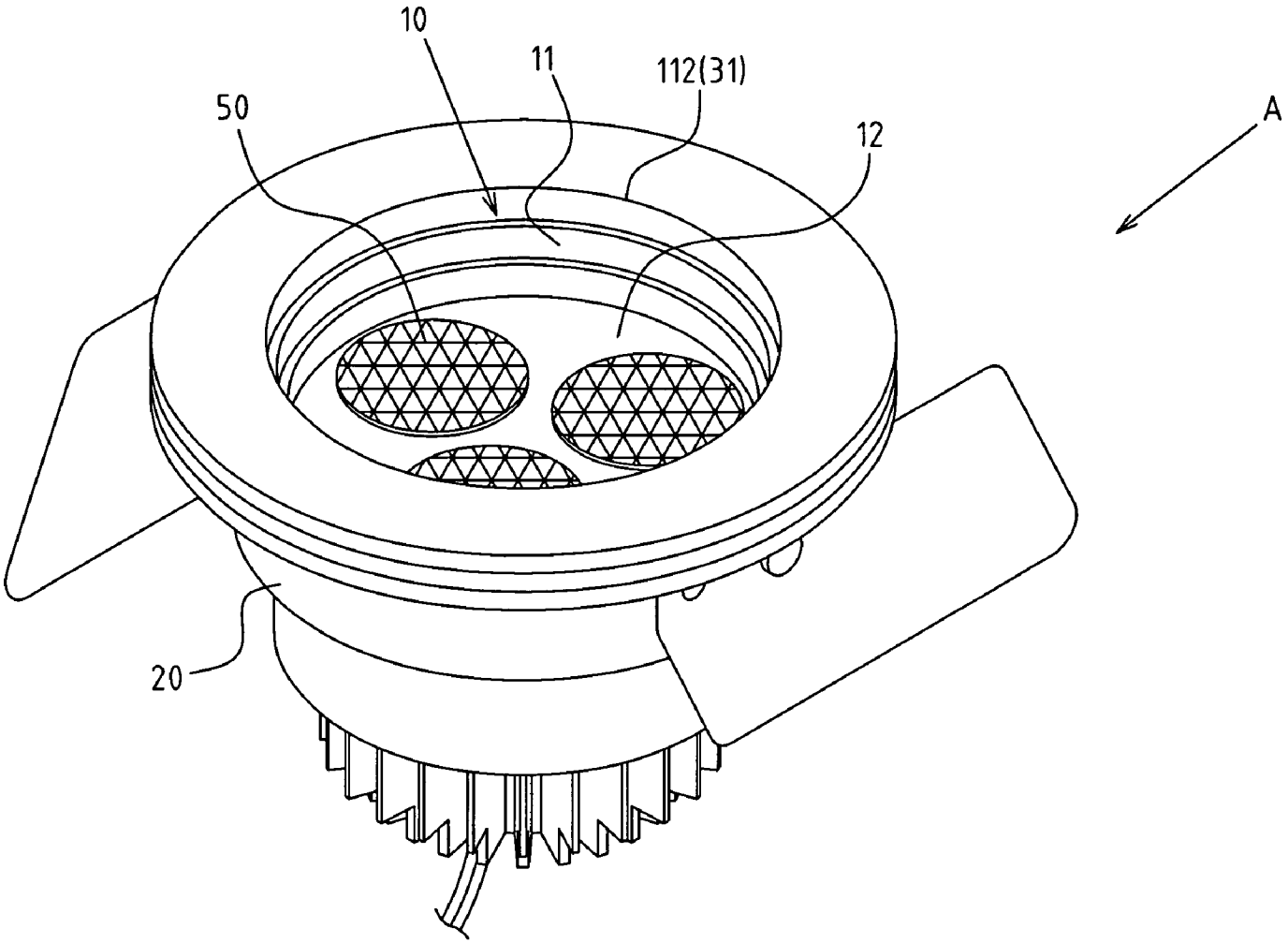
FIG. 1 shows an assembled perspective view of the preferred embodiment of the present invention.
Figure 2:
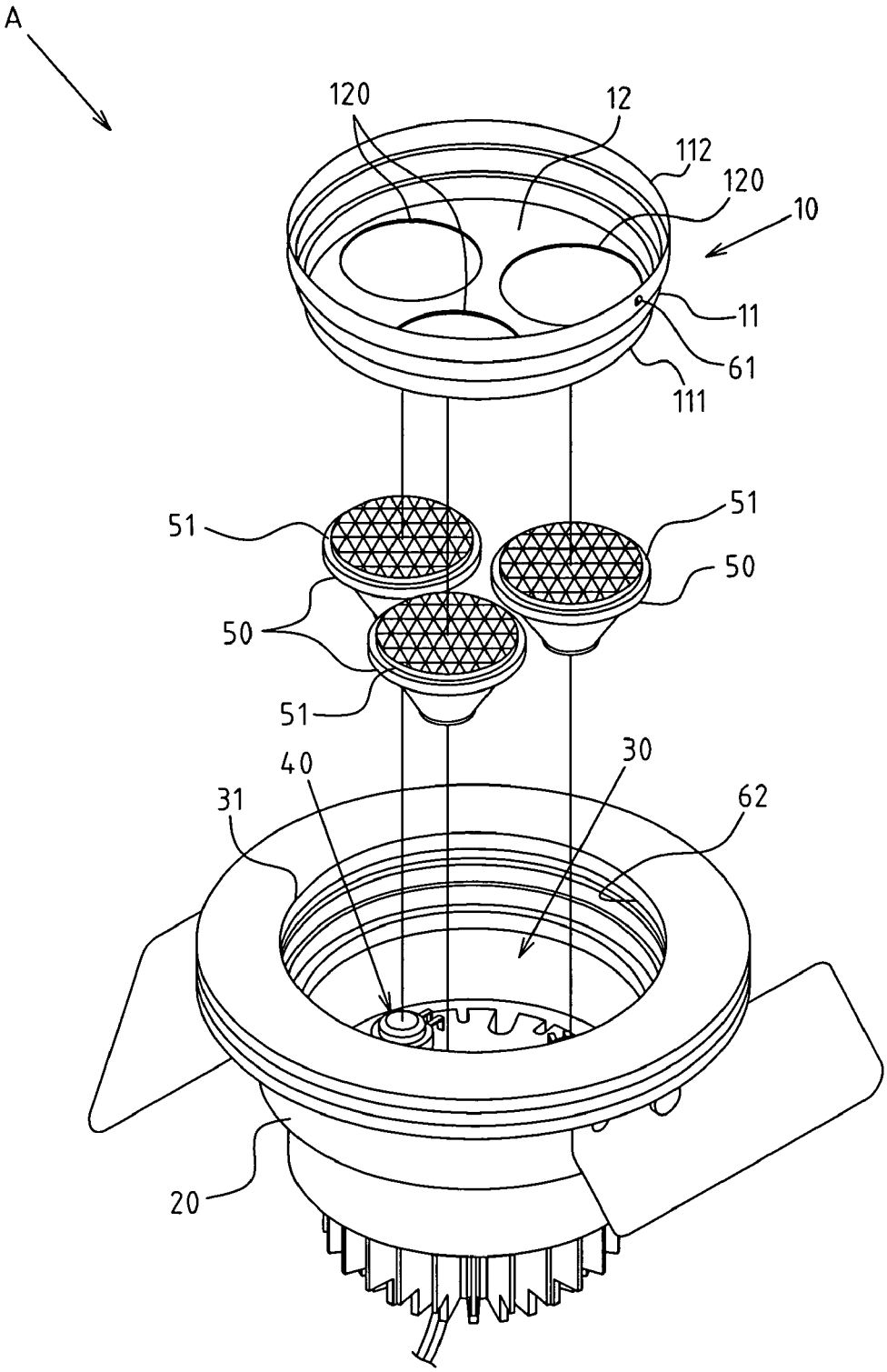
FIG. 2 shows an exploded perspective view of the preferred embodiment of the present invention.

The features and the advantages of the present invention will be more readily understood upon a thoughtful deliberation of the following detailed description of a preferred embodiment of the present invention with reference to the accompanying drawings.

FIGS. 1-4 depict preferred embodiments of improved lampshade for an LED lamp of the present invention. The embodiments are only provided for explanatory purposes with respect to the patent claims.

The lampshade 10 is assembled onto the port 31 of hold tank 30 on the main body 20 of LED lamp A (an embedded light structure), so that light-reflection modules 50 located between port 31 of hold tank 30 and LED modules 40 in the hold tank 30 are positioned securely.

The lampshade 10 comprises a circumferential locating surface 11 and a limitation surface 12. The circumferential locating surface 11 is adapted with the wall edge of hold tank 30 to define an inner edge 111 and an external edge 112. The limitation surface 12 is recessed into inner edge 111 of the circumferential locating surface 11 and is provided with several through-holes 120 for sleeving and limitation of the light-reflection modules 50. The circumferential locating surface 11 and the wall edge of hold tank 30 are coupled with snapping portion 60.

Figure 3:
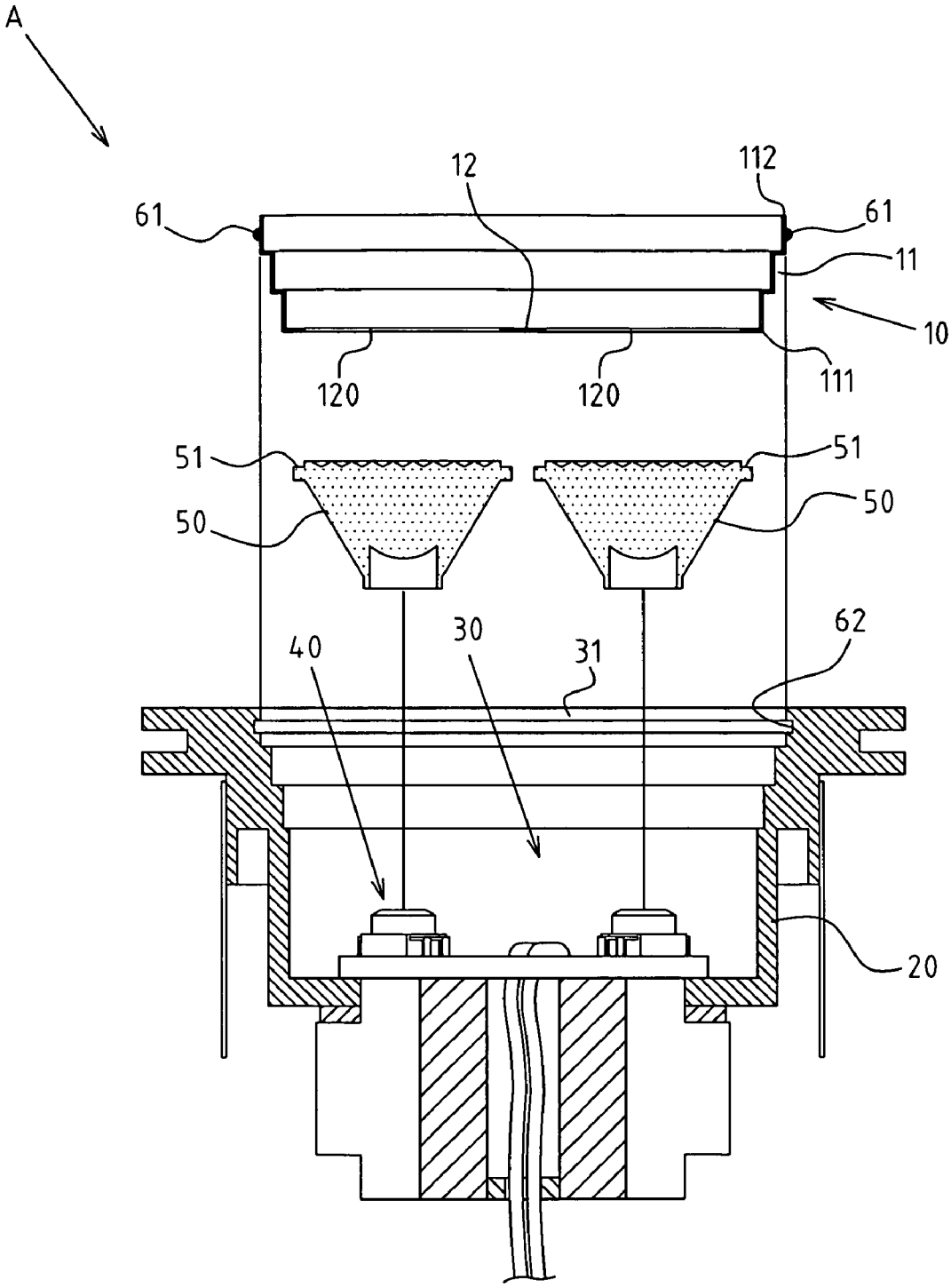
FIG. 3 shows an exploded sectional view of the preferred embodiment of the present invention.
Figure 4:
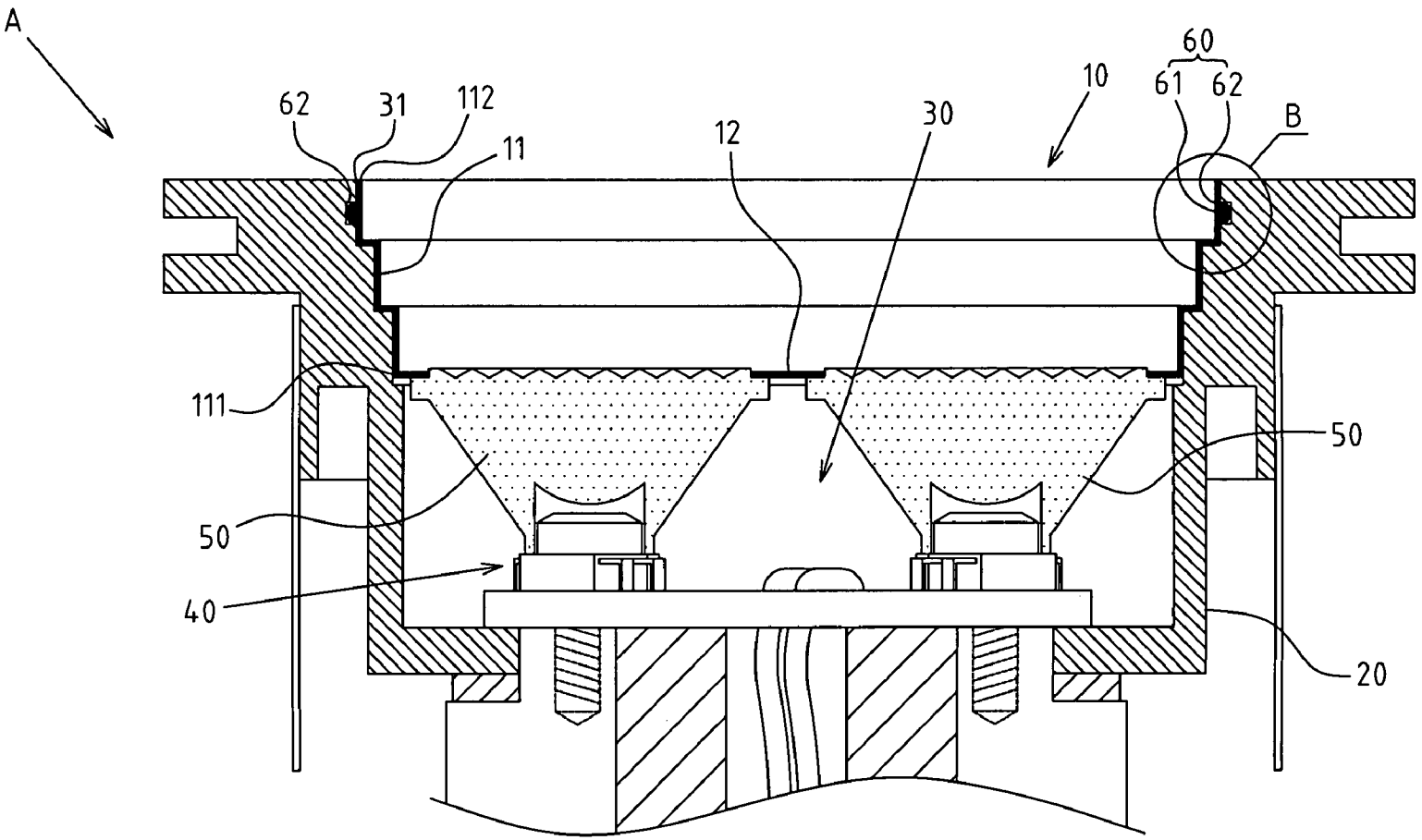
FIG. 4 shows an assembled sectional view of the preferred embodiment of the present invention.
Figure 5:
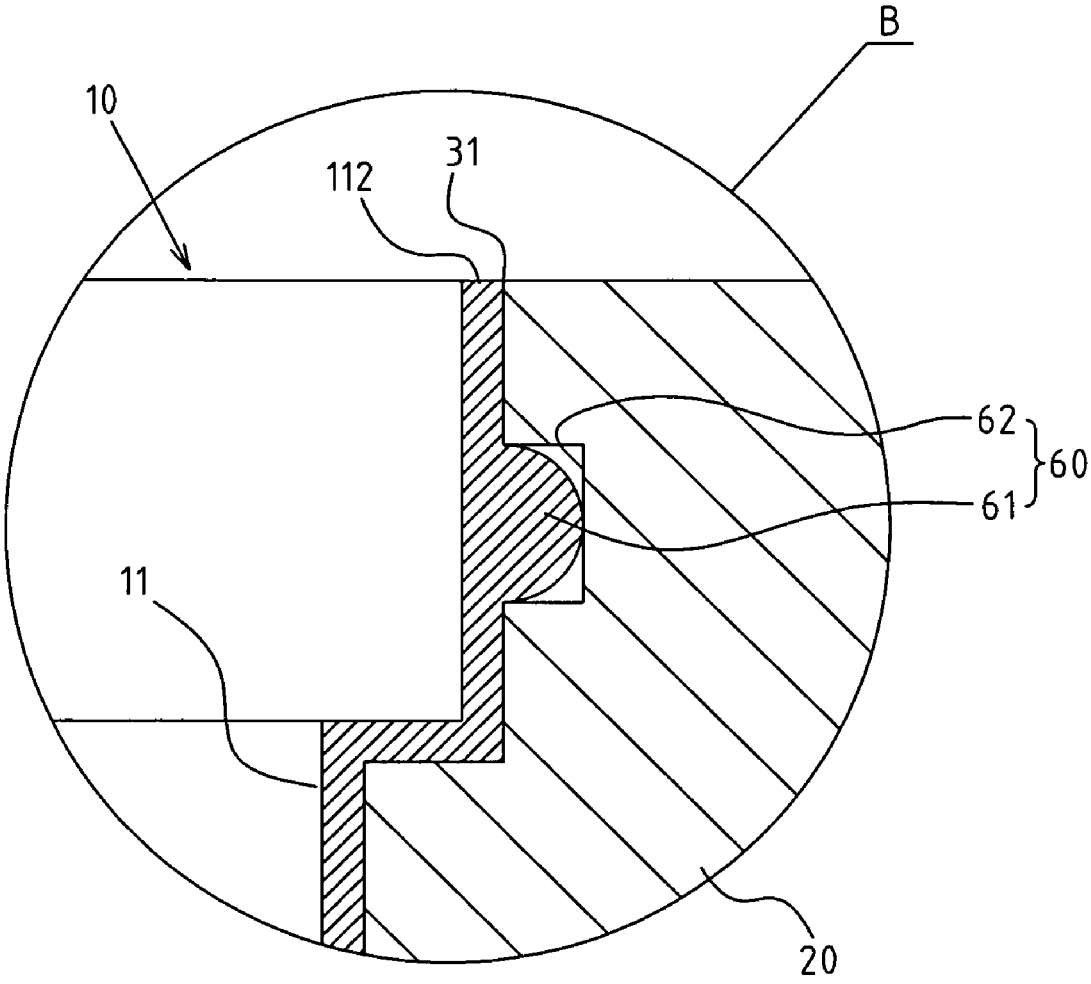
FIG. 5 shows a partially enlarged sectional view of portion B of FIG. 4.

Referring to FIGS. 3 and 4, the snapping portion 60 comprises a few locating flanges 61, arranged at intervals on the circumferential locating surface 11 of the lampshade 10, and a circular snapping groove 62 on the wall edge of hold tank 30 of the main body 20. When the lampshade 10 is mounted into the hold tank 30 of main body 20, it could be snapped rapidly into the circular snapping groove 62 via the locating flange 61 for positioning purpose.

The circumferential locating surface 11 of the lampshade 10 has a stepped external wall with big and small necks, and the wall edge of the hold tank 30 has a stepped inner wall with big and small treads.

A shoulder 51 is formed at one end of the light-reflection module 50, so that it could be located in the through-hole 120 of the limitation surface 12 of the lampshade 10 to securely fix the light-reflection modules 50.

Based upon above-specified structures, the present invention is operated as follows:

Referring to FIGS. 3 and 4, when the port 31 of the hold tank 30 of the main body 20 faces upwards, the light-reflection modules 50 are first placed into hold tank 30 of the main body 20 opposite to the LEDs on LED module 40. Then, the lampshade 10 is assembled into the port 31 of the hold tank 30 of the main body 20. In such a case, the light-reflection modules 50 are fastened into the through-hole 120 on the limitation surface 12 of the lampshade 10 and are positioned through the circumferential locating surface 11 of the lampshade 10 and snapping portion 60 on the wall edge of the hold tank 30. Thus, both lampshade 10 and light-reflection module 50 are fixedly assembled and positioned with the main body 20.

I claim:

1. An apparatus comprising:

a main body having a plurality of LED lamps therein;

a hold tank affixed to said main body, said hold tank having a wall edge, said wall edge having a groove extending circumferentially around an inner surface thereof, said wall edge defining a port at an end thereof opposite said main body;

a plurality of light-reflection modules positioned respectively over said plurality of LED lamps in said hold tank inwardly of said port; and a lampshade engaged with said wall edge of said hold tank and around said plurality of light-reflection modules, said lampshade comprising:

a circumferential locating surface positioned against said wall edge of said hold tank so as to define an inner edge and an external edge;

a limitation surface extending across said inner edge of said circumferential locating surface, said limitation surface having a plurality of through-holes respectively extending around said plurality of light-reflection modules; and a snapping portion formed on said circumferential locating surface for snap-fit engagement with said groove formed on said wall edge of said hold tank, said external edge of said circumferential locating surface being adjacent said port of said hold tank.

2. The apparatus of claim 1, said circumferential locating surface having a stepped external wall, said wall edge of said hold tank having a stepped inner wall.

3. The apparatus of claim 1, each of said plurality of light-reflection modules having a shoulder formed at an end thereof, said shoulder abutting said limitation surface.

4. The apparatus of claim 1, said snapping portion comprising a plurality of locating flanges arranged on said circumferential locating surface, said plurality of locating flanges releasably engaged with said groove of said wall edge of said hold tank.

* * * * *